United States Patent [19]

Bürki et al.

[11] 4,177,632

[45] Dec. 11, 1979

[54] ELECTRONIC WATCH

[75] Inventors: Jean-Jacques Bürki, St. Blaise; Hans G. Dill; Kurt Hübner, both of Neuchatel, all of Switzerland

[73] Assignee: Ebauches Electroniques S.A., Marin, Switzerland

[21] Appl. No.: 814,107

[22] Filed: Jul. 8, 1977

[30] Foreign Application Priority Data

Jul. 16, 1976 [CH] Switzerland ..... 9126/76

[51] Int. Cl.[2] ..... G04C 3/00

[52] U.S. Cl. ..... 58/23 BA; 58/23 R; 58/85.5

[58] Field of Search ..... 58/23 R, 23 AC, 23 A, 58/50 R, 23 D; 318/444–447; 307/132 EA

[56] References Cited

U.S. PATENT DOCUMENTS

| | | | |
|---|---|---|---|
| 3,745,760 | 7/1973 | Keeler | 58/28 R |
| 3,828,278 | 8/1974 | Rees | 331/116 R |
| 3,846,687 | 11/1974 | Daniels et al. | 318/446 |
| 3,999,368 | 12/1976 | Yoshida | 58/23 BA |
| 4,065,916 | 1/1978 | Leuschner | 58/23 BA |

*Primary Examiner*—Vit W. Miska
*Attorney, Agent, or Firm*—Imirie & Smiley

[57] ABSTRACT

Electronic watch provided with a release circuit in order to reduce the consumption of energy of the watch in its stocking condition. The release circuit is controlled through a delay circuit by a logic control circuit which is set in a particular "stocking" position by control means.

5 Claims, 2 Drawing Figures

ELECTRONIC WATCH

The present invention relates to an electronic watch with at least one oscillator circuit, circuits controlled by the oscillator, interface circuits, a delay circuit used in the stocking position of the watch, a logic circuit to select and control the functions of said watch and control means connected to the logic circuit. It is advantageous to sell an electronic watch whose probable battery life is not diminished.

Therefore, if it is intended to stock an electronic watch provided with its battery, it is obvious that the battery should not practically deliver any energy during the stocking time. Electronic watches are already known which are provided with a switch to disconnect the electronic circuits from the battery. Such an embodiment implies however additional components with indefinite reliability.

Stocking an electronic watch without battery leads obviously to more complications for the watchmaker making retail sales.

To solve this problem, the logic circuit of the electronic watch according to the present invention is set by control means in a particular condition amongst other possible conditions, said particular condition being used during the stocking of the watch and being able to disable at least part of the circuits of the watch in order to put said watch into a state of reduced energy consumption, disabling of said circuits being performed through said delay circuit due to which the time counting is not lost as, during the selection of the functions, said logic circuit switches from one position to another by passing through the intermediate stocking position.

The present invention will be described further, by way of example, with reference to the accompanying drawings in which.

Figure 1:
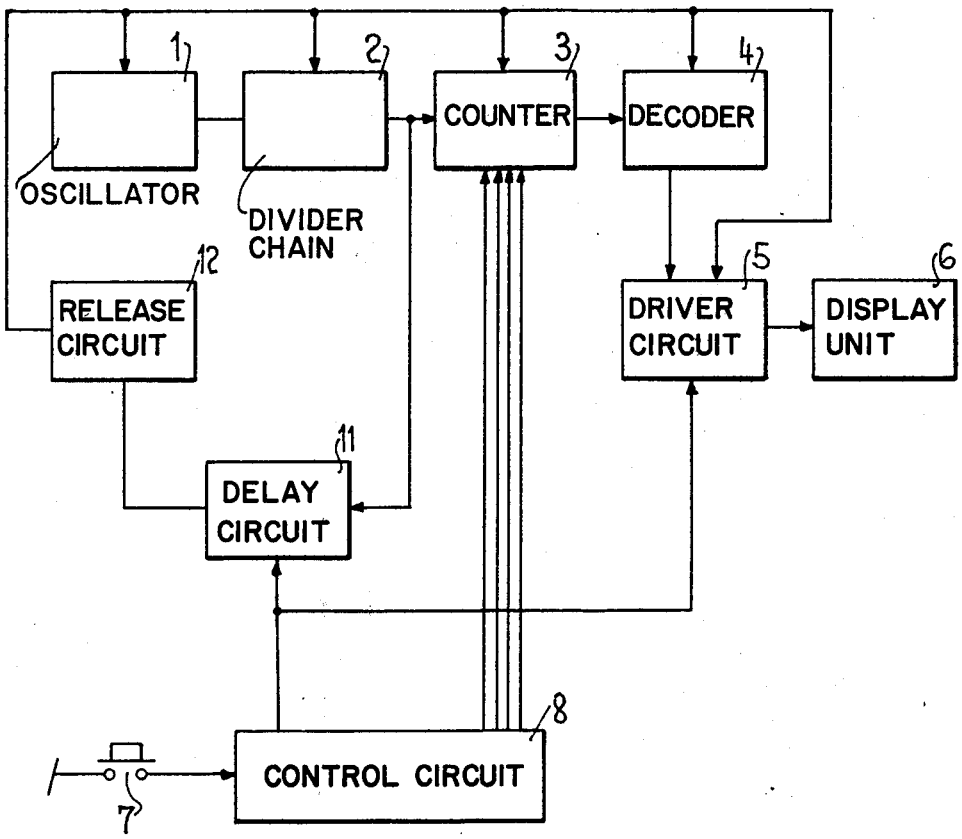
FIG. 1 is a block diagram of the electronic circuit.

The watch shown in FIG. 1 is provided with an oscillator 1 connected to a binary divider chain 2 connected itself to a counter 3 followed by a decoder 4, for example a BCD to seven segment decoder, and a driver circuit 5 for the display unit 6. This unit can display, for example, an information on four digits, each to seven segments.

The watch is provided with control means, in the circumstances with at least one push-button, operating a switch 7 whose make or break impulses actuate a logic electronic control circuit 8 provided, for example, with an n position shift register. The logic circuit delivers signals to the counter circuit 3 in order to control the desired functions to be displayed like, for example, hours/minutes or date/seconds or either to perform or to correct the time setting of the watch according to the different conditions of the logic circuit.

A particular condition or position of the logic circuit, named "stocking position" which, for commodity reasons, is placed at the beginning or at the end of the sequence which controls the functions which can be performed, generate a signal which stops the supply of the display and activates a delay circuit 11, for example, a binary counter. The output of the delay circuit 11 operates a release circuit 12 for example an electronic switch capable of stopping at least the oscillator 1. The same delay circuit 11 is able, should the necessity arise, to stop at least part of the circuits 2 to 5. The delay circuit is controlled by appropriate clock signals from the binary divider chain 2. It receives the stocking signal from the logic circuit 8 and transmits it to the release circuit 12 after a delay of a few seconds, minutes, hours or days.

Figure 2:
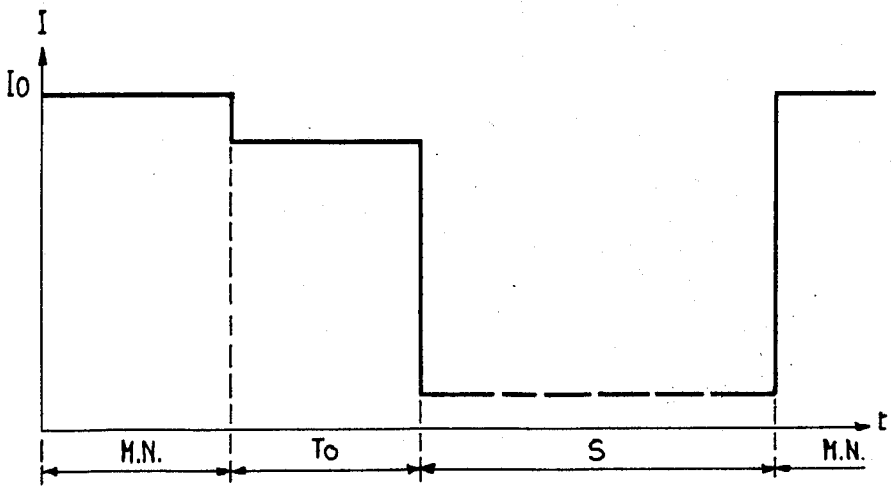
FIG. 2 is a diagram to illustrate the consumption of current during normal working mode and stocking of the watch.

The FIG. 2 is a diagram which illustrates, schematically, the energetic consumption of the watch. During a first step, the watch is operating normally and the current consumption is of a normal value Io.

When the logic circuit 8 is brought into its stocking position, a stocking signal is transmitted to the circuits 5 and 11. The supply of the display is immediately released, so that the watch bearer sees that the logic is in the stocking position and, therefore, the consumption falls slightly. The output of the delay circuit stays without any change during the time interval To.

Therefore, when the logic circuit is passing through the stocking position to arrive in another position which is, for example, either a normal display or a time correction of setting position, the circuits 1 to 4 still operate normally, so that the time is not lost. When the logic circuit is changing from the stocking to the next position, the stocking signal is suppressed and the display unit again indicates the time, as normal.

When the logic circuit stays in the stocking position, the stocking signal is transmitted at the end of the time interval To to the release circuit 12 which stops the oscillator and, should the necessity arise, other circuits which are not disabled by the stop of the oscillator. The consumption falls then to a very low level, determined only by the leaks in the control circuits which are necessary for the restoration, eventually, of the normal working of the watch.

At the end of the stocking time S, the logic circuit 8 is brought in one of the normal working position or in a starting position where a typical time and date, for example, January 1st, 00$^{00}$h is indicated. The stocking signal having vanished, the watch starts again to operate and to be fed normally. The display can then be set to the right time. During the stocking time the battery has lost very little energy.

The invention is not limited to the above described preferred embodiment. Similar functions can be obtained in a watch provided, for example, with a microprocessor.

The described embodiment offers amongst other the advantages that the watch need not to be opened and that no additional control element (push-button) is needed to put the watch in the stocking condition.

Instead of a logic electronic control circuit, able to be switched over to many positions by a push-button, it is also possible to use an electromechanical selector actuated by a crown, said selector being associated with a simplier logic circuit.

We claim:

1. An electronic watch adapted to be powered by at least one feeding battery and having an oscillator circuit, a frequency divider chain connected to said oscillator circuit, counter means connected to an output of said frequency divider chain for selecting a desired one function of at least two functions of said watch, decoder means connected to an output of said counter for decoding the output signal therefrom; a display means, and an interface means connected between said display means and said decoder means for the control of said display means; said watch further comprising a delay circuit connected to the output of said frequency divider chain for producing a time delay $T_o$;

a logic circuit connected to said delay circuit and having at least three serial, shiftable stages, each stage having an output corresponding to a possible function of said watch, one of said stages corresponding to a stocking condition;

and a control means for controlling the sequential shifting between said logic circuit stages and thus for controlling the function to be displayed by said display means;

said delay circuit being activated and said display means being visably deactivated by the logic circuit so as to indicate immediately that the logic circuit is in said stocking condition when first placed therein such that the output of said delay circuit remains unchanged until the end of said time $T_o$ and the time counting is not lost when if before the end of said time delay $T_o$ said logic circuit is switched out of the stocking position, such as when during the selection of the functions of said watch said logic circuit is shifted from one condition to another through the intermediate stocking condition, and such that at the end of said time delay $T_o$, said delay circuit is capable of at least indirectly disabling at least part of the circuits of said watch to put said watch into said stocking condition which is a state of reduced energy consumption in which said logic circuit can still be fed by the battery so that upon further activation of said control means said logic circuit can be switched out of said stocking condition.

2. Watch as claimed in claim 1 wherein said oscillator controls said divider chain, said counter and said decoder;

wherein said interface circuits comprise a driver circuit controlling said display;

wherein said release circuit comprises means to deactivate the oscillator, the divider chain, the counter, the decoder and the driver circuit controlling said display; and wherein said logic circuit comprises logic elements for reactivating the above mentioned electronic circuits and said display when a further change of the state of said logic control circuit occurs upon actuation of said control means.

3. Watch as claimed in claim 1 and further including a release circuit connected to the output of and operated by said delay circuit for disabling at least part of the electronic circuits of the watch.

4. Watch as claimed in claim 1 wherein said logic circuit comprises a serial input, parallel output, n stage shift register, where n is greater than or equal to 3, the output from a first stage which corresponds to the stocking condition being connected to said delay circuit and said driver circuit for the control thereof and the outputs from two or more stages being connected to said counter means and corresponding to desired functions to be displayed by said display means.

5. Watch as claimed in claim 4 wherein said first stage corresponding to the stocking condition is located at one of the end stages of said shift register.

* * * * *